US008505841B2

(12) United States Patent
Davis et al.

(10) Patent No.: US 8,505,841 B2
(45) Date of Patent: Aug. 13, 2013

(54) ANTI-JAMMING ASSEMBLY FOR SHREDDERS OF SHEET LIKE MATERIAL

(75) Inventors: Josh Davis, Hudson, OH (US); Russell T. Chambers, North Canton, OH (US); Kenneth Hydak, Strongsville, OH (US); BaoJun (Will) Zhao, DongGuan (CN); Hua (Kevin) Ren, DongGuan (CN); RuiPing Wang, Dongguan (CN); JieGuang (Jiemy) Zhou, DongGuan (CN)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 241 days.

(21) Appl. No.: 12/684,017

(22) Filed: Jan. 7, 2010

(65) Prior Publication Data

US 2010/0176227 A1 Jul. 15, 2010

Related U.S. Application Data

(60) Provisional application No. 61/143,788, filed on Jan. 11, 2009.

(51) Int. Cl.
*B02C 21/00* (2006.01)
*B02C 23/00* (2006.01)

(52) U.S. Cl.
USPC ..... 241/36; 241/100; 241/236

(58) Field of Classification Search
USPC ..... 241/36, 100, 236, 225
See application file for complete search history.

(56) References Cited

U.S. PATENT DOCUMENTS

| | | | | |
|---|---|---|---|---|
| 3,724,766 | A | 4/1973 | Bosland | |
| 4,817,877 | A * | 4/1989 | Itoh et al. | 241/34 |
| 4,842,205 | A * | 6/1989 | Araki et al. | 241/34 |
| 5,775,605 | A | 7/1998 | Tsai | |

(Continued)

FOREIGN PATENT DOCUMENTS

| | | |
|---|---|---|
| EP | 0281136 A2 | 9/1988 |
| GB | 2377899 A | 1/2003 |

(Continued)

OTHER PUBLICATIONS

European Search Report; EP App. No. 10000174.2-2316; dated Jun. 23, 2010; Munich, Germany.

(Continued)

*Primary Examiner* — Faye Francis
(74) *Attorney, Agent, or Firm* — Hahn, Loeser & Parks, LLP

(57) ABSTRACT

An anti-jam assembly for incorporation in an article destroying appliance includes a fixed core mount assembly including a first support member spaced apart from a second support member. At least one moveable cutter shaft is disposed between and rotatably mounted to the first and second support members. A third elongate member extends in parallel relationship to the at least one cutter shaft. This third support member is moveable from a first position to at least a second position. The first and the at least second position correspond to a variable width of a feed path directing an article toward the at least one cutter. An arm is affixed to the elongate member and pivotal at a mounting surface when the elongate member moves toward the second position. A sensor activates when it detects movement of the arm. The arm and the sensor are removed from a proximity of the at least one cutter or the feed path.

7 Claims, 8 Drawing Sheets

(56) References Cited

U.S. PATENT DOCUMENTS

| | | | | |
|---|---|---|---|---|
| 6,550,701 | B1 | 4/2003 | Chang | |
| 7,624,938 | B2 * | 12/2009 | Aries et al. | 241/36 |
| 2007/0246582 | A1 | 10/2007 | Aries | |

FOREIGN PATENT DOCUMENTS

| | | | |
|---|---|---|---|
| GB | 2451301 | A | 1/2009 |
| JP | 57-070445 | U | 4/1982 |
| JP | 9-38513 | | 2/1997 |
| JP | 2002-239405 | A | 8/2002 |

OTHER PUBLICATIONS

GBC Shredmaster Serivce Manual, Part#6001054, Referencing Model 2230S and 2250X Paper Shredders, Copyright 1997, Printed in the USA.
English Translation of JP 57-070445U, 1982.
English Translation of JP 9-38513, 1997.
English Translation of JP 2002-239405 A, 2002.

* cited by examiner

ANTI-JAMMING ASSEMBLY FOR SHREDDERS OF SHEET LIKE MATERIAL

This application claims the benefit of priority to U.S. Provisional Patent Application No. 61/143,788, filed Jan. 11, 2009, entitled "ANTI-JAMMING ASSEMBLY FOR SHREDDERS OF SHEET LIKE MATERIAL", by Josh Davis, et al., the disclosure of which is hereby incorporated by reference in its entirety.

BACKGROUND

The present disclosure is directed toward an anti-jam assembly for incorporation in an article destroying device and, more specifically, to an assembly including one or more moveable members at least partially defining a feed path and a sensor for suspending operation of mechanical systems of the destroying device.

One of the causes for service to certain shredder models is repeat jams. A jam condition disrupts project flow when an article fed into a shredder device wedges tightly between at least one moving component and a second component of the system, thus causing the moving component to lock into an unworkable state. The occurrence of a jam condition is in most instances caused by a media sheet or a stack of media sheets having a thickness that exceeds a maximum capacity of which the shredder can handle. Generally, the mechanical systems, such as, for example, a motor, gears, and rotating cylinders, are capable of handling media thicknesses within certain ranges. Stack thicknesses are tested as they relate to the number of Amps drawn on the motor. Excessive loading results when thicknesses draw an Amperage that causes the motor to stop working. In most instances, the motor needs a period of relief before the shredder device can complete the project.

There are known shredders that disable mechanical systems when stack thicknesses are in excess of a predetermined capacity. One known method utilized in a known shredder includes utilizing a mechanical switch that is moved from a first position to a second position when overly thick media pushes against a lever connected thereto. More specifically, an opposite portion of this lever is situated in a path generally in proximity to an entrance of the throat. Another method includes disabling the mechanical systems when the media comes within close proximity to a sensor that reads the conductivity of the media. This sensor is similarly situated in proximity of the throat and, more specifically, on an exterior of the shredder housing.

There are no known shredder systems that utilize a corresponding focus beam generator and receiver type sensor system to suspend an operation of the mechanical systems when overly thick media is inserted into the throat. Rather, known shredder devices generally incorporate focus beam sensors to activate the motor when media is placed in proximity to the entrance of the throat, i.e., feed slot. More specifically, the sensor generates a beam that is directed toward or travels in proximity to the entrance of the throat. Media interrupts the beam as it moves into the throat, thus causing the mechanical systems to activate. One aspect associated with sensors including transmitter and/or receiver photodiodes situated in the feed slot is that the shredder will fault when dust collects on a face of the sensor. The sensors are generally exposed to dust circulating in an environment exterior to the sensor. This dust falls into the feed slot and settles on the sensor. If the sensor is not routinely cleaned, it will inaccurately conclude that media is inserted into the slot. The motor may continue to run when no media is present.

Utilization of a focus beam sensor is a reliable means to detect specific conditions relating to the over-feeding of media into the feed throat of a destroying device. The present disclosure therefore includes a thickness detection sensor that includes at least one of a transmitter and receiver situated in a closed region away from the throat and the external environment.

BRIEF DESCRIPTION

In one embodiment of the present disclosure, an anti-jam assembly is described for incorporation in an article destroying appliance. The anti-jam assembly includes a fixed core mount assembly including a first support member spaced apart from a second support member. At least one moveable cutter shaft is disposed between and rotatably mounted to the first and second support members. A third elongate member extends in parallel relationship to the at least one cutter shaft. This third support member is moveable from a first position to at least a second position. The first and the at least second position correspond to a variable width of a feed path directing an article toward the at least one cutter.

Another embodiment of the present disclosure is directed toward a shredder device for fragmenting at least one media sheet having a variable thickness. The shredder device includes a bin having a containment space for collecting fragments formed from the at least one media sheet. The shredder device further includes a head assembly adjacent to the bin. The head assembly includes a core mount assembly supporting a motor drive assembly and a cutter assembly. The head assembly further includes an optical sensor that generates a focus beam for sensing the variable thickness of the at least one media sheet. A controller is operatively associated with the optical sensor and the motor drive assembly. A media feed path directs a travel of the at least one media sheet toward the cutter assembly. The optical sensor is removed from both the media feed path and the cutter assembly such that it generates the focus beam away from a proximity of the media feed path and the cutter assembly.

A further contemplated embodiment of the present disclosure is directed toward an anti-jam assembly for incorporation in a destroying appliance utilizing at least one cutter shaft. The anti-jam assembly includes a variable width feed path directing material toward the cutter shaft. The feed path is defined on at least one side by a finger extending from a moveable supporting member. An arm is affixed to the supporting member and pivotal at a mounting surface when the at least one finger is urged downwardly toward the at least one cutter by the article. A sensor activates when the arm pivots from a first position to a second position. The arm and the sensor are removed from a proximity of the at least one cutter or the feed path.

DETAILED DESCRIPTION

The present disclosure is directed toward an anti-jam assembly for incorporation in an article destruction device including at least one moveable destroying component. The anti-jam assembly detects a size measurement of an article that exceeds a predetermined threshold value. This threshold is more specifically a maximum size measurement that the anti-jam assembly is capable of handling without causing at least one destruction component included therein from becoming temporarily inoperable.

With respect to the present disclosure, one contemplated article destruction device is a shredder appliance of planar sheet media. The shredder device may be a non-industrial shredder appliance that is generally utilized in households, business offices, and commercial spaces for the destruction of media containing sensitive content. The media sheets destroyed by these shredder devices may include paper materials (e.g., hand- and type-written documents), metallic materials (e.g., storage discs, s.a., CDs and DVDs), and plastics material (e.g., credit and bank cards).

Figure 1:
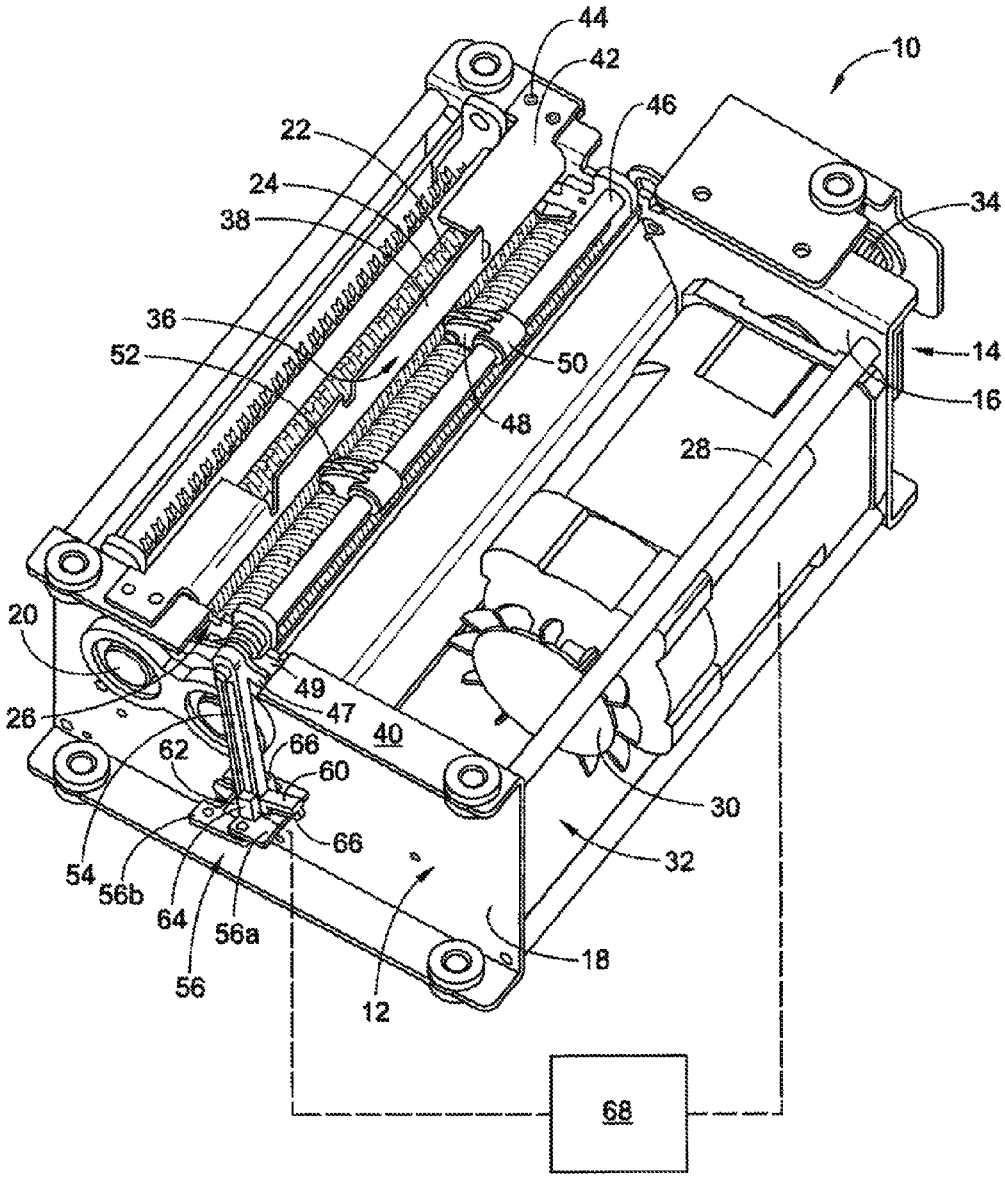
FIG. 1 is a perspective view of anti-jam assembly according to an embodiment of the disclosure, wherein the anti-jam assembly is shown in a first operational mode when incorporated in an article destruction device.
Figure 8:
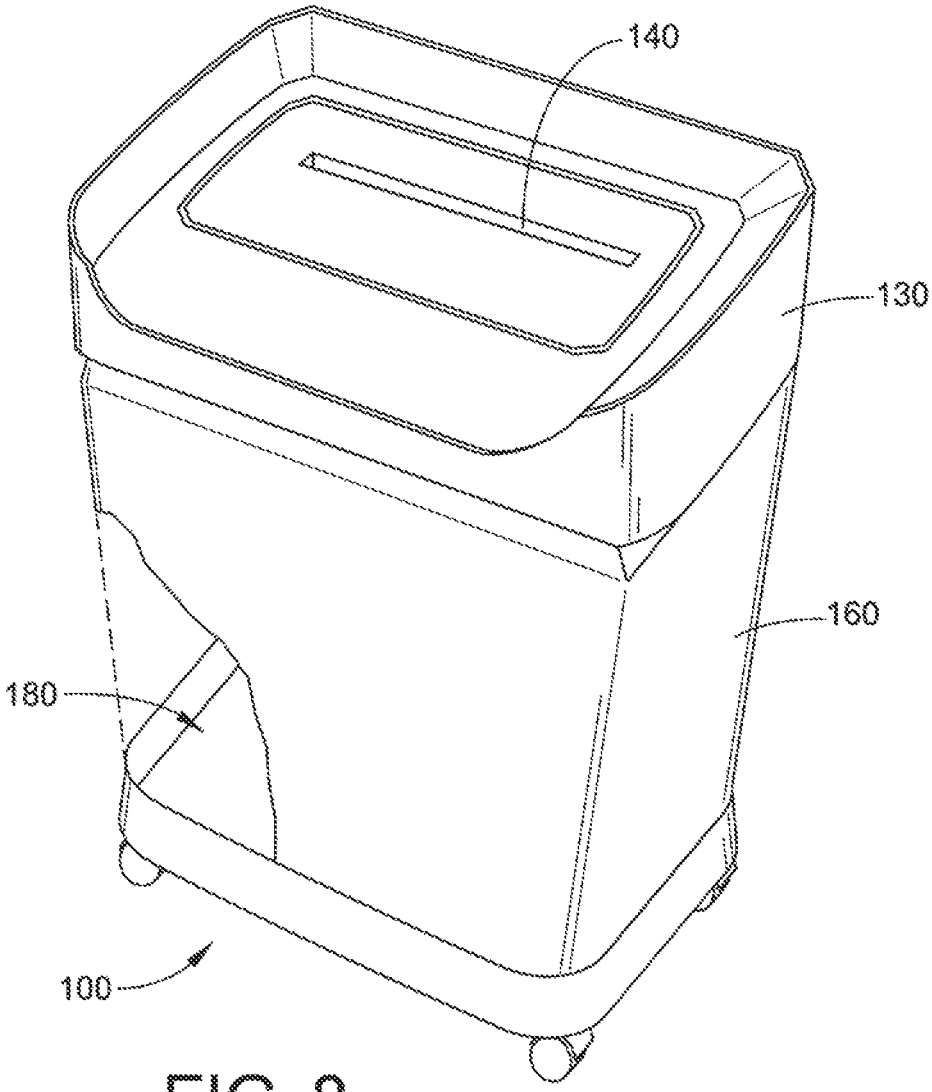

FIG. 1 is a perspective view of a core mount assembly 10 (also known as a cutting head section), which is contained in a closed housing adjacent to a collection receptacle, such as, for example, bin 160 shown in FIG. 8. The cutting head section 10 generally supports all of the mechanical and electrical components of the shredder device. The core mount assembly 10 illustrated in the figure includes a first support member 12 opposite a second support member 14. The support members 12, 14 are spaced apart in generally parallel relationship. The support members 12, 14 are shown to include a first surface (hereinafter "inner face 16") and a second surface (hereinafter "outer face 18"). Any support member is contemplated which includes inner- and outer-oriented faces. Examples of support members include generally vertical walls or elongate rods.

One function of the first and second support members 12, 14 is to rotatably support at least one cutting shaft 20 (hereinafter synonymously referred to as "cutting cylinder"). The at least one cutting shaft 20 is illustrated to include a longitudinal extent that is generally perpendicular to the first and second support members 12, 14. Distal ends of the at least one cutting shaft 20 are shown as being rotatably mounted to the first and second support members 12, 14 such that the cutting shaft 20 spaces apart the support members 12, 14. The cutting shaft 20 includes a plurality of spaced apart discs 22 connected thereto. Spacers or spacer discs 24 are situated between adjacent cutter discs 22. The cutter discs 22, or blades protruding therefrom, puncture the media or article passing along a circumferential surface of the cutting cylinder 20. In the illustrated embodiment, a second cutting cylinder 20 extends parallel to the first cutting cylinder 20. The parallel cutter shafts 20 operate as a cutting assembly when they counter-rotate. Media passes between a feed gap 26 formed there between adjacent inner circumferential surfaces of the cutting cylinders; however, embodiments are contemplated in which one cutting cylinder 20 works in conjunction with a fixed component, such as, for example, a set of sharp tines, to destroy the media.

At least one additional third support member 28 may be included extends perpendicular to and connecting the first and second support members 12, 14. The third support member(s) 28 adds structural integrity to the core mount assembly 10. A motor 30 or motor drive assembly is fixedly attached to at least one of the first and second support members 12, 14 (hereinafter described as the second support member 14). The motor is affixed to the inner face 16 of at least the second support member 14 such that it occupies a space or a compartment 32 formed between the first and second members 12, 14 behind the at least one cutting cylinder 20. The motor 30 imparts (forward and/or reverse) motion on the at least one cutting cylinder 20 by means of a plurality of gears 34. These gears 34 are attached to the outer face 18 of the at least second support member 14 supporting the motor 30.

The present disclosure hereinafter describes a means to prevent media, which may be overly thick, from jamming the cutting cylinder(s) 20 or de-energizing the motor 30. The mechanical systems (i.e., the cutting cylinder 20, the motor 30, and the gears 34) of the present disclosure continue to operate as long as a thickness of media measures under a predetermined threshold. The media is guided down a media feed path 36 (i.e., feed slot, throat, or throat portion) toward the feed gap 26 formed between the cutting cylinders 20. In one embodiment, illustrated in FIGS. 2 and 3, the media is guided down a media feed path defined along one longitudinal extent by a first feed path assembly. This first feed path assembly includes a first elongate rod 102 fixedly connected to the first and the second mount supports 12, 14 at its terminal ends. The solidly mounted elongate rod 102 is illustrated as a shaft, but there is no limitation made herein to any cross-sectional shape for an elongate body. The first feed path assembly further includes a second elongate rod 104 rotatably connected to the first and second mount supports 12, 14. This second elongate rod 104 is illustrated as a shaft, but such rod can include an elongate body having any cross-sectional shape. The second elongate shaft 104 is more specifically rotatably mounted to the first and the second support mounts 12, 14. The solidly mounted elongate rod 102 (hereinafter synonymously referred to as "fixedly mounted elongate rod") is parallel to the rotatably mounted elongate rod 104, but it is offset therefrom in both the generally horizontal and vertical planes. The solidly mounted elongate rod 102 is offset from the rotatably mounted elongate rod 104 in a direction toward the feed gap 26. More specifically, the solidly mounted elongate rod 102 is situated in a generally horizontal plane below that of which the rotatably mounted elongate rod 104 is situated. In this manner, the fixedly mounted elongate rod 102 is situated generally closer to a circumferential surface of the at least one cutting cylinder 30.

The rotatably mounted elongate rod 104 includes at least one standup (synonymous to "stand-off" or "spacer" or "guide") member 106 extending toward the fixedly mounted elongate rod 102. The illustrated embodiment includes two standup members 106 generally evenly spaced apart at one-third (⅓) length portions of the shaft 46. Other embodiments are contemplated to include multiple standup members 106 in spaced apart relationship along an entire longitudinal extent of the rotatably mounted elongate rod 104. One exemplary embodiment can include three standup members 106 positioned at the one-quarter (¼), the one-half (½), and the three-quarters (¾) length portions of the rotatably mounted elongate rod 104. Another exemplary embodiment can include five standup members 106 situated at every one-fifth ($1/5^{th}$) length portion of the rotatably mounted elongate rod 104. Embodiments are contemplated in which the standup members 106 are evenly and/or unevenly spaced apart. Gaps 110 are formed between the adjacent faces of neighboring standup members 106.

The illustrated standup members 106 include a channel defined by at least one continuous wall 108 at a first end that wraps around to surround the rotatably mounted elongate rod 104. The standup members 106 are fixedly connected to the rotatably mounted elongate rod 104 at the channel 108 such that they do not rotate any distance around the rotatably mounted the elongate rod 104. For rotatably mounted elongate rods 104 having a non-circular cross-sectional shape, the continuous wall 108 of the standup member 106 defines a channel space of the same cross-sectional shape. In other embodiments (not shown), the standup member 106 can include other attachment mechanisms, such as, for example, a non-continuous wall that selectively or fixedly attaches onto the rotatably mounted elongate rod 104 or a distal flange that mechanically fastens to a corresponding face of the rotatably mounted elongate rod 104.

Figure 2:
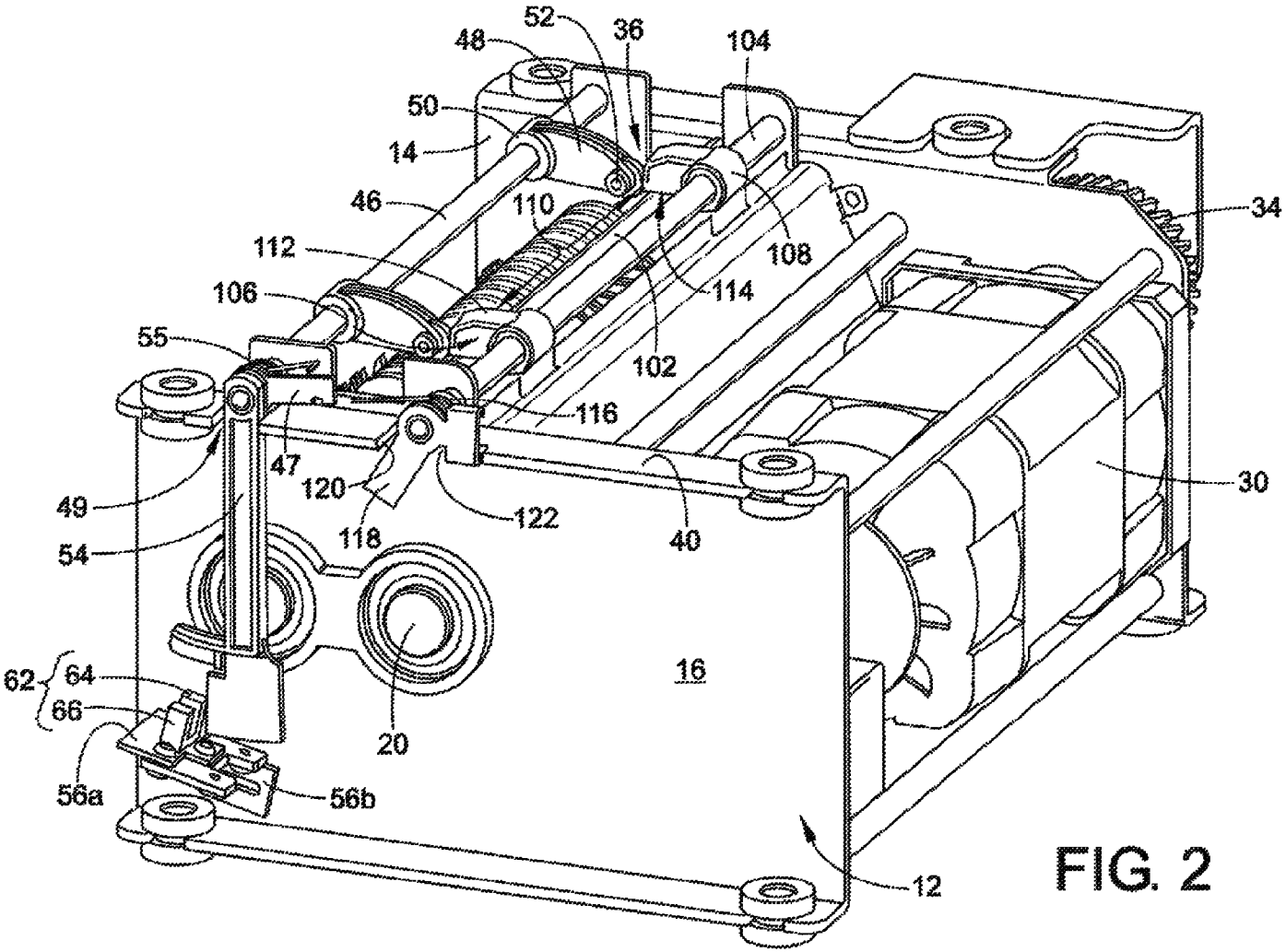
FIG. 2 is a perspective view of an anti-jam assembly according to another embodiment of the disclosure, wherein the anti-jam assembly is shown in a first operational mode when incorporated in an article destruction device.

In the illustrated embodiment of FIG. 2, the second distal end of the standup member 106 includes a generally arcuate inner oriented face 112 (i.e., top and side surface) for contacting media to be destroyed or shredded for minimizing a resistance to the media pushing through. A second distal end of the standup member 106 may rest in a first, home position on the fixedly mounted elongate rod 102. More specifically, an undersurface 114 of the standup member 106 may be in contact with a circumferential surface of the fixedly mounted elongate rod 102 when the rotatably mounted elongate rod 104 is in the home position (see FIG. 2). This home position is generally associated with a forward, i.e., downward, movement of media through the feed path.

Figure 3:
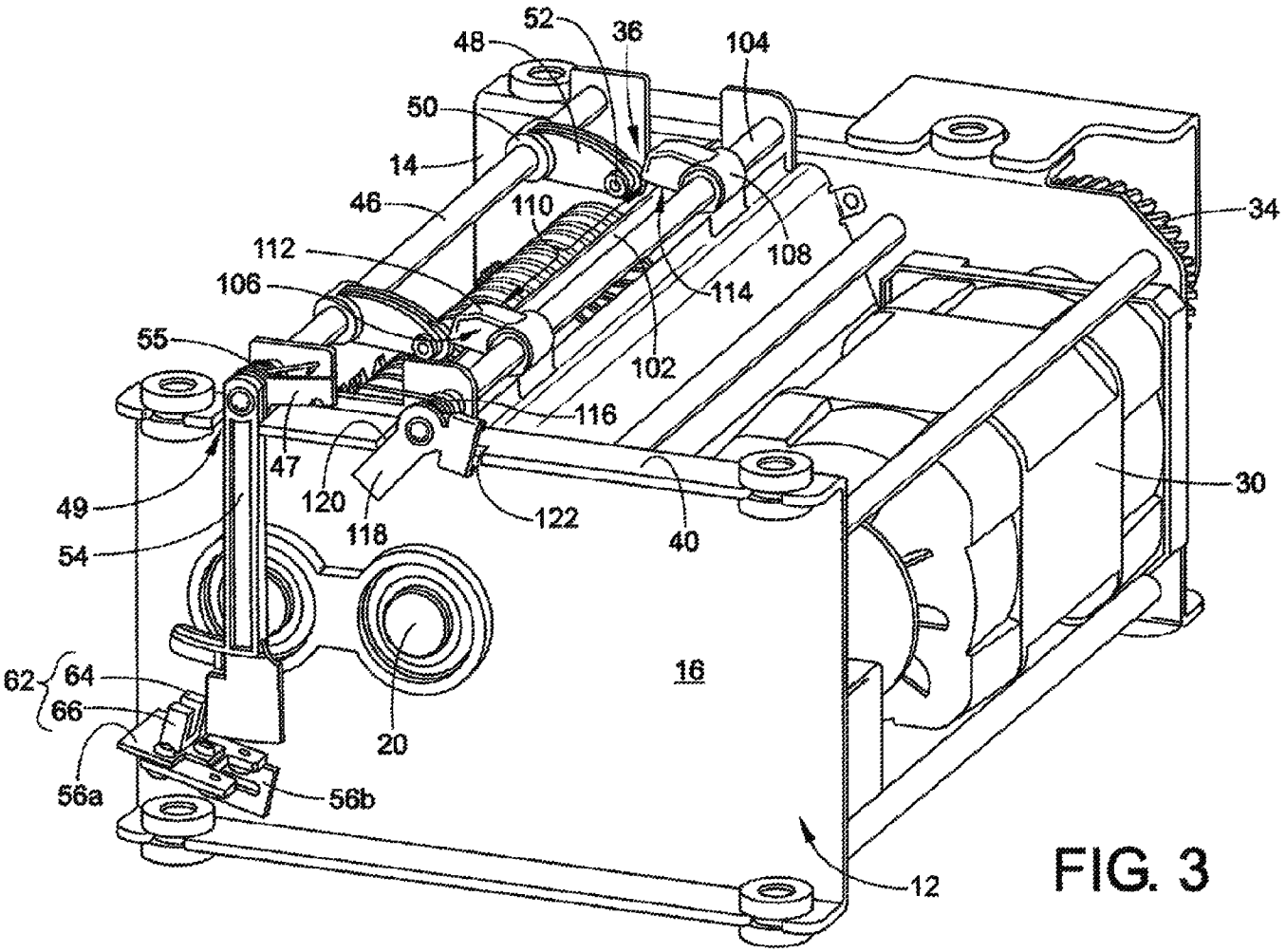
FIG. 3 is a perspective view of the anti-jam assembly of FIG. 2, wherein the anti-jam assembly is shown in a second operational mode.

An aspect associated with the first feed path assembly is that it allows media to be more easily removed from the shredder device in instances of a jam or an approaching jam. More specifically, the media can more easily pass through the gaps 110 (verses a planar wall or plate embodiment) when it is being pulled outwardly from the shredder device. The media is also more freely removed from the shredder device by means of the rotatably mounted elongate rod 104 rotating from the first position to a second position, as is shown in FIG. 3. The rotatably mounted elongate rod 104 rotates (illustrated in the figures as clockwise) generally away from the cutting cylinders 30. As the rotatably mounted elongate rod 104 rotates from the first position to the second position, it lifts the standup members 106 away from the fixedly mounted elongate rod 102. The standup members 106 are removed from having contact with the fixedly mounted elongate rod 102 so that media situated within their proximity can be pulled away therefrom.

It is anticipated that the media being urged upwardly out of the shredder device may push the standup members out of contact with the fixedly mounted elongate rod 102. In an event that it is necessary to counter-rotate or to lift the standup members off of the fixedly mounted elongate rod 102, a mechanical linkage (not shown) can be incorporated to move or rotate the rotatably mounted elongate rod 104.

The rotatably mounted elongate rod 104 is biased to the first position such that it returns to that first position when no force is applied thereto or to the standup members 106. The rotatably mounted elongate rod 104 may be biased in one embodiment by means of a spring 116 wrapped around a portion of its longitudinal extent. This spring 116 is illustrated in FIGS. 2 and 3 as being wrapped in proximity to a terminal portion of the rotatably mounted elongate rod 104.

A mechanical stop 118 may also fixedly connected to the rotatably mounted elongate rod 104. This mechanical stop 118 is illustrated in the figures as being a generally planar flange 118, but there is no limitation made to a shape, a dimension, or an orientation of the mechanical stop 118. The mechanical stop 118 limits a rotation of the rotatably mounted elongate rod 104 to a predetermined degree. As the mechanical stop 118 rotates with the rotatably mounted elongate rod 104, it eventually comes into stopping contact with a stop member 120. In the illustrated embodiment, the stop member 120 is formed on a mount support 12, 14. More specifically, an inward step 122 is formed through an outwardly-extending flange-like top edge portion 40 of the mount support 12. The mechanical stop 118 rotates freely about a limited degree within a space formed in the inward step 122. At a predetermined degree of rotation, the mechanical stop 118 contacts a wall defining a portion of the inward step 122. This wall functions as the stop member 120. The present disclosure is not limited to, however, the corresponding mechanical stop and stop member described herein. Any similarly functioning mechanism can be utilized with the present disclosure to stop continuous rotation of the rotatably mounted elongate rod 104.

In another contemplated embodiment, the feed slot 36 is defined along a first longitudinal side by a throat plate 38, as shown in FIG. 1. This throat plate 38 may be situated both between and transverse to the first and second support members 12, 14. More specifically, the throat plate 38 is supported generally above the cutting cylinders 20 and, more specifically, above the feed gap 26 in proximity to an inner circumferential surface of the at least one cutting cylinder 20. At least a portion of the throat plate 38 is situated in a plane that is generally parallel to the plane in which the media extends as it is moved through the feed slot 36 toward the space formed between the cutting cylinders (i.e., feed gap 26). In the illustrated embodiment, a middle portion of the throat plate 38 is shown as extending generally upwardly (i.e., vertically) from the feed gap region 26. In another embodiment, the throat plate 38 can extend upwardly from the feed gap region 26 along its entire longitudinal extent. In another embodiment, at least two spaced apart portions of the throat plate 38 can extend upwardly from the feed gap 26. In another embodiment, a middle portion of the throat plate 38 can extend generally downwardly (i.e., vertically) into or in the direction toward the feed gap region 26. In another embodiment, the throat plate 38 can extend downwardly from the feed gap region 26 along its entire longitudinal extent. The throat plate 38 is connected at both ends to top edge portions 40 of the first and second support members 12, 14. For generally planar first and second support members 12, 14, the top edge portions can include a generally perpendicular flange 40 that can extend in- or outwardly for purposes of mounting the throat plate 38. For support members 12, 14 of the elongate rod embodiment, the throat plate 38 can mount to the top face of the rod. The illustrated throat plate 38 is shown to include terminal mount portions 44 that are situated in a (horizontal) plane generally perpendicular to the upwardly extending middle throat plate portion. The mount portions 42 of the throat plate 38 are not limited to the generally horizontal mount portions herein; rather, any embodiment is contemplated which functions to permit a surface portion of the throat plate 38 to affix to a surface portion of the first and second support members 12, 14. One embodiment can include first and second support members 12, 14 having an inner face 16 that extends a height beyond the cutting cylinder 20 sufficient to support an adjacent outer face 18 on a terminal portion of the throat plate 38. For example, in one embodiment (not shown), the throat plate 38 can include the generally vertical planar surface portion along the entire longitudinal extent of the cutting cylinder 20, and the throat plate 38 can include a 90-degree bend in this planar surface at the inner face 16. In another embodiment, the throat plate 38 can also include a terminal end that splits into a T-bar, wherein each branch of the T-bar affixes to the support member 12, 14.

The throat plate 38 affixes to the first and second support members 12, 14 by means of a standard mechanical fastener 44. An adhesive can reinforce or alternately be used to maintain the attachment. In another embodiment (not shown), the terminal portions 42 of the throat plate 38 can include a channel that selectively or fixedly attaches over an upper edge 40 of the first and second support members 12, 14. This method of attachment can securely support the throat plate 38 by means of an interference fit. Alternatively, an adhesive or a mechanical fastener can further secure the attachment.

The present core mount assembly 10 includes an opposite component defining second side of the feed path 36. The static throat plate 38 or a predetermined length of the standup members 106 create a reference. However, the opposite component is moveable such that a general width of the feed path 36 is variable. It is anticipated that a maximum width of the feed path 36 may be greater than a maximum thickness of media that the mechanical systems 20, 30, 34 of the device can handle. Therefore, the opposite component can move away from the throat plate 38 a predetermined distance before the mechanical systems 20, 30, 34 automatically stop operating. The opposite component is urged away from the throat plate 38 by media of certain thicknesses being fed into the feed slot 36.

The opposite component is illustrated in the figures as including an elongate throat member 46 extending opposite of and parallel to the throat plate 38. The elongate member 46 is supported above the at least one cutting cylinder 20 and, more specifically, above the feed gap 26 in proximity to an inner circumferential surface of the second counter-rotating cutting cylinder 20 or stationary component (situated opposite the at least one cutting cylinder 20). The elongate member 46 is illustrated as (and hereinafter referred to) an elongate shaft 46, but it is not limited to any one cross-sectional shape. A rod member can be similarly utilized to accomplish the hereinafter described function.

The elongate shaft 46 includes at least one finger member 48 extending toward the opposite throat plate 38. The illustrated embodiment includes two fingers 48 generally evenly spaced apart at one-third (⅓) length portions of the shaft 46. Other embodiments are contemplated to include multiple fingers 48 spaced apart along an entire longitudinal extent of the shaft 46. One exemplary embodiment can include three fingers 48 positioned at the one-quarter (¼), the one-half (½), and the three-quarters (¾) length portions of the shaft 46. Another exemplary embodiment can include five fingers 48 situated at every one-fifth ($1/5^{th}$) portion of the shaft 46. Embodiments are contemplated in which the fingers 48 are evenly and/or unevenly spaced apart.

The illustrated fingers 48 include a channel defined by at least one continuous wall 50 that wraps around to surround the shaft 46. The fingers 48 are fixedly connected to the shaft 46 such that they do not rotate any distance around the shaft 46. For rods 46 having a different cross-sectional shape, the continuous wall 50 of the finger 48 defines a channel space of the same shape. In other embodiments (not shown), the fingers 48 can include other attachment mechanisms, such as, for example, a non-continuous wall that selectively or fixedly attaches onto the elongate member 46 or a distal flange that mechanically fastens to a corresponding face of the elongate member 46.

In one embodiment, the distal tip of each finger 48 includes a rotating member 52. In one embodiment, the rotating member 52 is a roller 52. In one embodiment, the roller 52 is a spherical roller that is capable of rotating in at least one direction. The roller 52 more specifically rotates in at least a forward direction (i.e., with forward insertion of the media). In another embodiment, the roller 52 is capable of rotation in at least the forward direction and an opposite reverse direction (i.e., with rearward retrieval of the media). The roller 52 rotates when an external force of the media is applied thereto. The roller 52 functions to assist in gliding the media through the feed path 36. In another embodiment, the roller 52 is a cylindrical roller, such as, for example, a wheel 52 that is capable of movement in only the forward and/or reverse directions. Another aspect of the roller 52 is to ease resistance when media is fed both downwardly through the feed path and removed upwardly through the feed path. As media is fed downwardly through the feed path 36 toward the feed gap 26 between the rotating cutting cylinders 20, it moves freely between the throat plate 38 and the fingers 48. However, certain media will not freely move between the throat plate 38 and the fingers 48 if the media thickness exceeds a width of the feed path 36. This media will urge against and push the fingers 48 (downwardly and/or) outwardly away from the throat plate 38. It is anticipated that media can move against the fingers 48 within thickness ranges that will not automatically stop the mechanical systems 20, 30, 34. In other words, the fingers 48 are constructed to offer some give. As the fingers 48 are pushed by media, they simultaneously move or rotate the shaft 46 relative to the throat plate 38.

Figure 4:
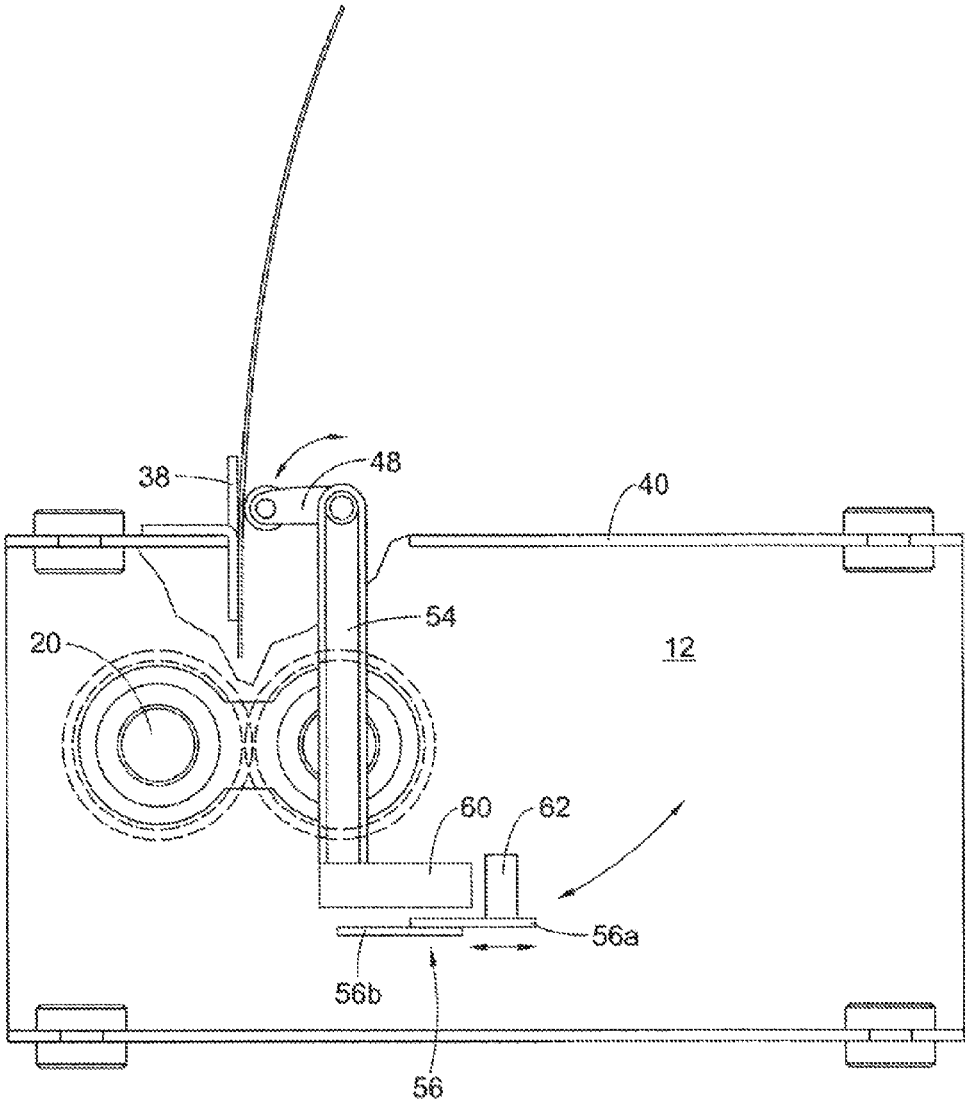
FIG. 4 is a side view of a rotatable shaft embodiment of the anti-jam assembly of FIG. 1 in a first operational mode.
Figure 5:
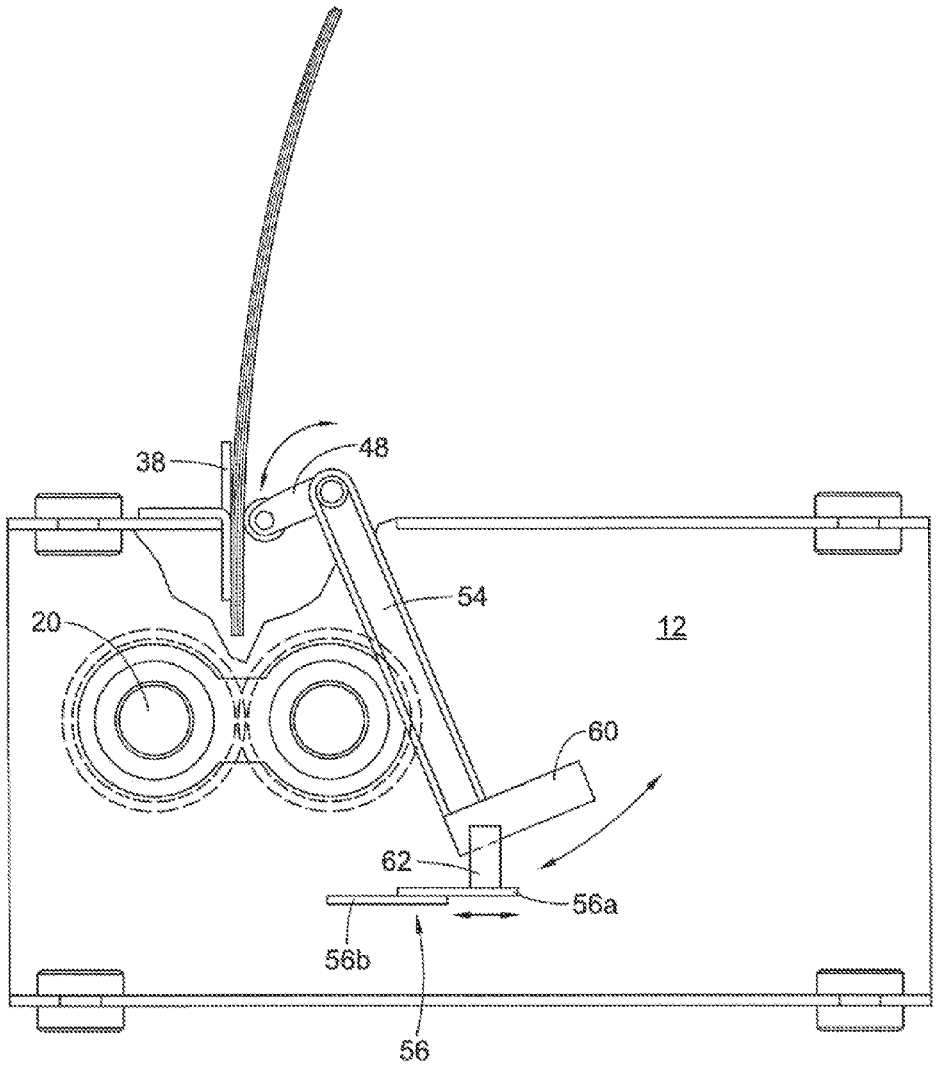
FIG. 5 is a side view of the rotatable shaft embodiment of the anti-jam assembly of FIG. 4 in a second (default) operational mode.
Figure 6:
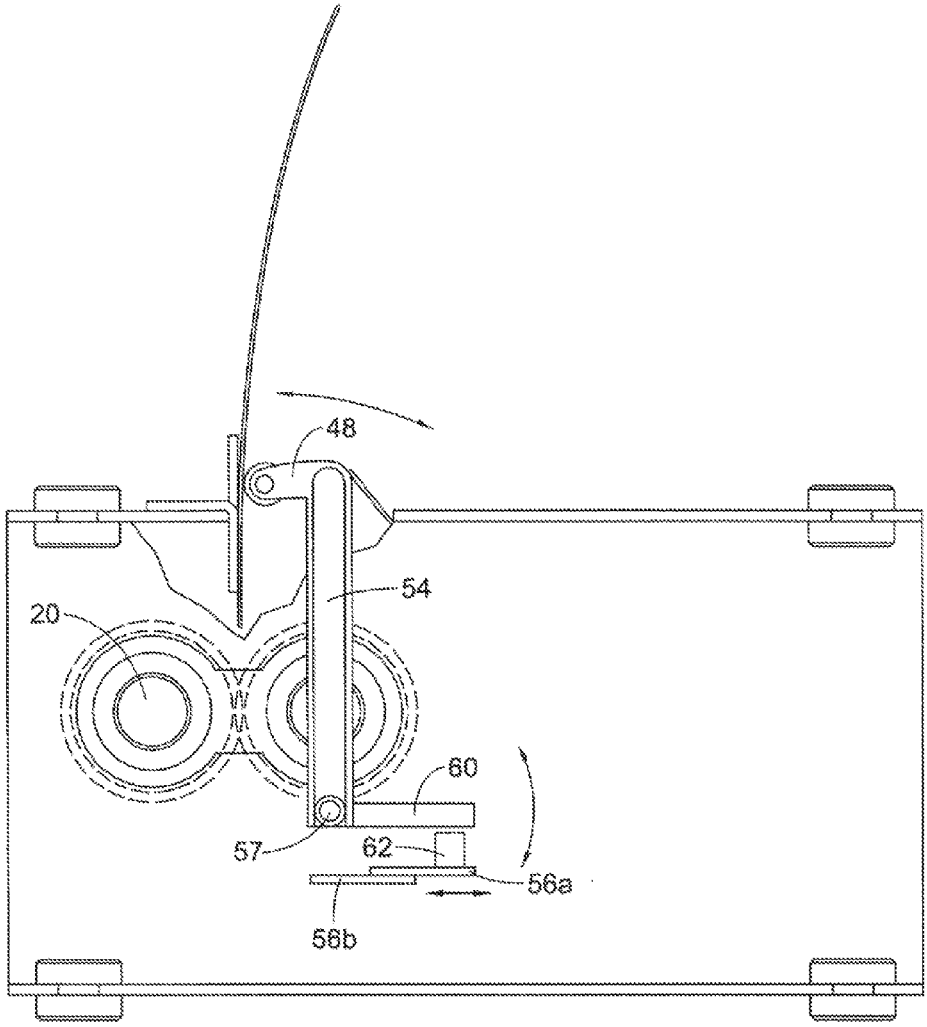
FIG. 6 is a side view of a moveable shaft embodiment of the anti-jam assembly in a first operational mode.
Figure 7:
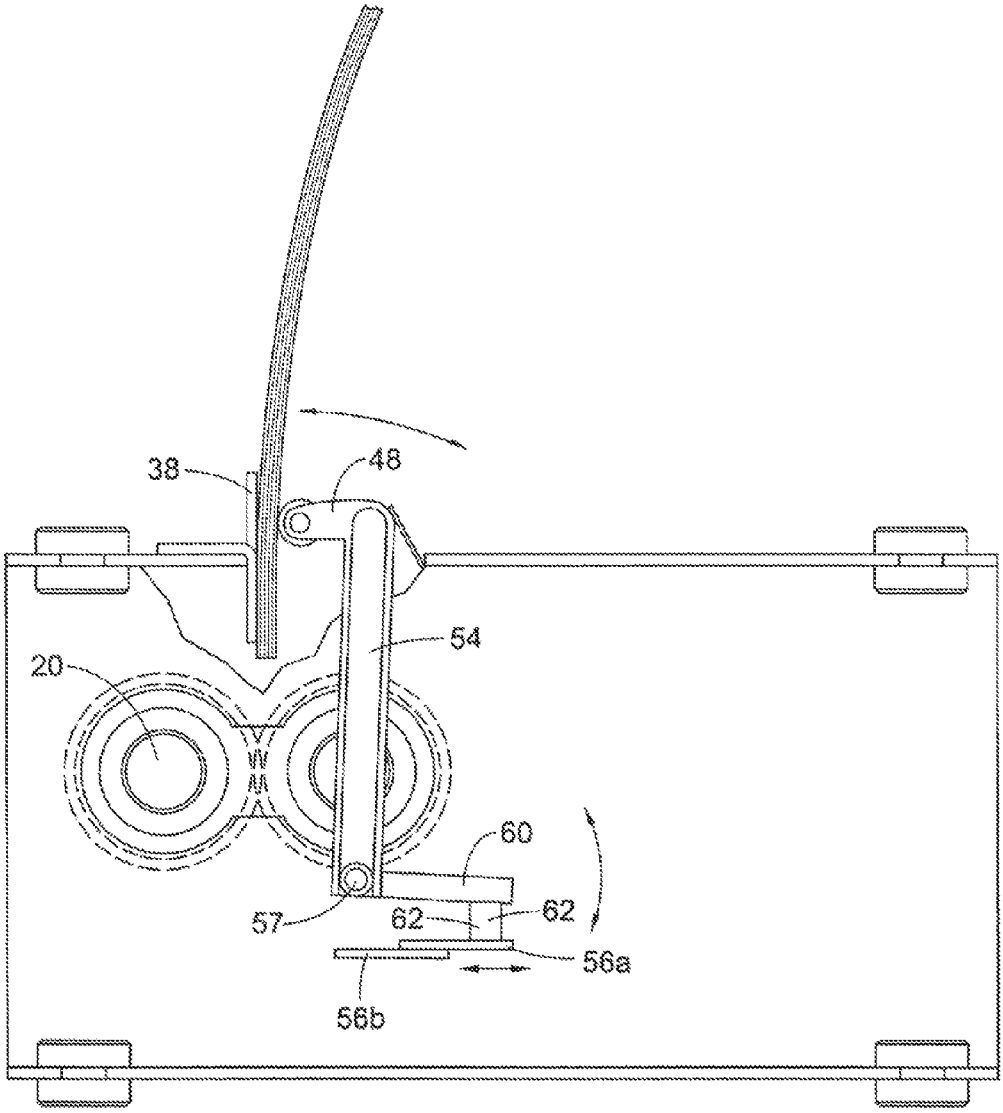
FIG. 7 is a side view of the anti-jam assembly of FIG. 6 in a second operational (default) mode; and, FIG. 8 is a side view of a media shredder appliance for incorporation of the anti-jam assembly.

The shaft 46 is rotatable in a first contemplated embodiment, shown in FIGS. 4 and 5, and moveable in a second contemplated embodiment, shown in FIGS. 6 and 7. More specifically, at least one terminal end of the shafts 46 is fixedly connected to an arm 54. Generally, the terminal end of the shaft 46 attached to the arm 54 is the end that is situated farthest from the gears 34. It is anticipated that the arm 54 is pivotal at an outer face 18 of the mount support spaced apart from the mount support supporting the gears.

The rotatable shaft embodiment of the presently disclosed throat assembly is illustrated in two operative modes in FIGS. 4 and 5. As media is fed downwardly through the feed path 36 toward the feed gap 26 between the rotating cutting cylinders 20, it moves freely between the throat plate 38 and the fingers 48. However, certain media will not freely move between the throat plate 38 and the fingers 48 if the media thickness exceeds a width of the feed path 36. This media will urge against and rotate the fingers 48 downwardly toward the feed gap 26. It is anticipated that media can move against the fingers 48 within thickness ranges that will not automatically stop the mechanical systems 20, 30, 34. In other words, the fingers 48 are constructed to offer some give. As the fingers 48 are pushed by media, they simultaneously rotate the shaft 46.

The shaft 46 is rotatably mounted at distal ends by means of a fixed or solidly mounted pin member 47. This pin member 47 connects is fixedly connected to the corresponding mount support (illustrated as first mount support 12). A gap 49 is formed in the flange-like top edge 40 of the first mount support 12. The pin member 47 is more specifically connected to the first mount support 12 between terminal edge portions defining the gap 49. There is no limitation made herein to a means of connecting the pin member 47 to the first mount support 12 as long as a function of maintaining the shaft 46 is accomplished. More specifically, the pin member 47 maintains that the shaft 47 does not shift or move in any linear direction.

At least one terminal end of the shaft 46 is fixedly connected to an arm 54. Generally, the terminal end of the shaft 46 attached to the arm 54 is the end that is situated farthest from the gears 34. As the shaft 46 rotates from the first position to the second position, the arm 54 similarly rotates from a first position to a second position. In the embodiment illustrated in FIGS. 4 and 5, the arm pivots at its fixed connection to the shaft 46. The arm pivots in a manner similar to a pendulum action. The arm 54 is spring biased. A tension coil spring can wrap around a portion of a longitudinal extent of the arm 54. More specifically, the coil spring can wrap around the portion of the arm 54 in proximity to its connection at the shaft 46. Therefore, as media, that may be overly thick, is fed through the feed path 36, it pushes the fingers downwardly, which rotate the shaft 46 outwardly, which also cause the arm 54 to rotate or swing against the bias. When media is removed from the feed path, the arm 54 counter-rotates and returns the shaft 46 to the first position.

In the rotatable shaft embodiment illustrated in FIGS. 4 and 5, the entire longitudinal extent of the arm 54 is situated in a region exterior to the mechanical systems 20, 30, 34 of the core mount assembly 10. More specifically, the entire longitudinal extent of the arm swings adjacently to an outer face 18 of the core mount assembly 10.

In the illustrated embodiment, the second terminal end of the arm 54 swings in proximity to a platform 56 that extends outwardly from the outer face 18 of the first support member 12. The platform 56 is generally perpendicular to the outer face 18 of the support member 12, 14 it protrudes therefrom. The platform 56 includes a first moveable first planar platform member 56*a* slideably engageable with a fixed or solidly mounted second planar platform member 56*b*. A threshold for sensing a later-discussed detected condition is made adjustable by the user as the first planar member 56*a* slides relative to the second planar member 56*b*.

In the illustrated embodiment, the platform 56 supports a sensor 62 mounted thereon its top face. The sensor 62 is a standard optical sensor that includes a transmitter component 64 and a corresponding receiver component 66. The transmitter component 64 generates a focus beam, which is received by the receiver component 66. One aspect of the sensor 62 is a location of the transmitter and receiver components 64, 66. As is illustrated, at least one of the transmitter 64 and receiver 64 are situated outside of the core mount assembly 10. More specifically, the transmitter and/or receiver 64, 66 may be situated both outside a proximity of the following regions: (1) the compartments and space formed between the inner faces 16 of the of the first and second support members 12, 14; (2) an entrance to the feed slot 36; (3) the feed path 36; and, (4) an exit slot below the feed gap 26. In this manner, an occurrence is minimized of media fragments or dust settling into contact with the sensor components 64, 66.

It is anticipated that the arm 54 includes a width that is smaller than a distance between the sensor components 64, 66. In this manner, the arm 54 may swing along a path having a portion that extends between the sensor components 64, 66. The arm may further include an extension 60 that protrudes from its free terminal end. This extension 60 extends outwardly in a same plane of which the arm 54 swings in. The arm 54 or the extension 60 can bisect the focus beam which is generated across its path between the sensor components 64, 66.

A relationship between the first platform member 56*a* and the second platform member (i.e., a position of the sensor components 64, 66) corresponds to the maximum thickness of media that the mechanical systems 20, 30, 34 can tolerate without too excessive a load being applied to the systems. The sensor 62 detects when the media thickness exceeds a predetermined threshold value. This threshold is reached when the fingers 48 cause the shaft 46 to rotate, and the rotating shaft 46 causes the arm 54 to swing directly into a path of the focus beam, thus obstructing the beam from being received by the receiver component 66. The core mount assembly 10 further includes a controller 68, which is operatively associated with both the sensor 62 and at least the motor 30. The controller 68 can be operatively associated with other indication systems utilized in the device, such as, for example, bin full capacity. The controller 68 is programmed to recognize the signal sent from the receiver component 66 as a detected fault condition. In this manner, the controller 68 may control at least one of the following actions: (1) suspend the motor 30 for at least a predetermined amount of time; (2) reverse the motor 30 to reverse a rotation of the cutting cylinder(s) 20 for a predetermined duration; (3) activate an indication system to warn the operator of the fault condition; and (4) any combination of the foregoing. The warning can be a visible warning communicated to the operator by means of a display that illuminates. Alternatively, the warning can be an audible warning communicated to the operator by one or a series of beeps. Alternatively, the warning can be a visible or an audible message stating that the fault condition is met or that the media (stack) is too thick.

FIG. 5 illustrates the second operative mode of the rotatable shaft embodiment of the core mount assembly 10 when the thickness fault condition is detected. The figure illustrates the media pushing against the fingers 48. As the media is forced downwardly through the feed path 36 toward the space between the counter-rotating cutters 20, the fingers 48 are rotated in a generally downward direction. Because the fingers 48 are not rotatably attached to the shaft 46, they do not rotate about the shaft 46; rather, overly thick media will push against the fingers 48 and cause the fingers 48 to similarly rotate the shaft 46. As the shaft 46 rotates from the first position toward the second position, the arm 54 swings in a same (illustrated as counter-clockwise) direction. When the arm 54 bisects the focus beam of the sensor 62, it causes the controller 68 to activate the illustrated operative mode, wherein the operation of the mechanical systems 20, 30, 34 is suspended. When the operations are suspended, the operator may pull the media from the feed slot 36 or the controller 68 may reverse rotation of the cutting cylinders 20 to assist in removing the media from the feed path 36. Once the media is removed from the feed path 36, the bias of the arm 54 returns the shaft 46 and the fingers 48 to the home position (i.e., the first operative mode).

The moveable shaft embodiment of the presently disclosed throat assembly is illustrated in two operative modes in FIGS. 6 and 7. The arm 54 allows for the shaft 46 to move from a first position to at least a second position. In one embodiment, the first position (hereinafter synonymously referred to as "home position") of the shaft 46 is situated closest to the throat plate 38 and the second position is situated farthest from the throat plate 38. The arm 54 is spring biased to return the shaft 46 to the first position. The media will push the shaft 46 outwardly, which will also cause the arm 54 to push against the bias.

In one embodiment, a first terminal end of the arm 54 is attached to the shaft 46 and a second terminal end of the arm 54 is attached to one of the first or second support members 12, 14. In the illustrated embodiment, the second terminal end of the arm 54 is attached to the outer face 18 of the support member (illustrated as the first support member 12). In this manner, the entire longitudinal extent of the arm 54 is situated in a region exterior to the mechanical systems 20, 30, 34 of the core mount assembly 10.

In the illustrated embodiment of FIGS. 6 and 7, the second terminal end of the arm 54 is attached to a platform 56 that extends outwardly from the outer face 18 of the first support member 12. This platform 56 enables the arm 54 to be spaced a clearance from the outer face 18 such that movement of the arm 54 does not cause the arm 54 to contact any moving components of the mechanical systems 20, 30, 34, such as, for example, the cutting shaft 20 where it is rotatably mounted to the first support member 12. The platform 56 is generally perpendicular to the outer face 18 of the support member 12, 14 it protrudes therefrom.

In the illustrated embodiment of FIGS. 6 and 7, the platform 56 includes two upwardly extending spaced apart support walls 58, wherein the arm 54 is fixed by a hinge situated between the hinge support walls 58. In the present embodiment, the second terminal end of the arm 54 is pivotally attached to the first support member 12 at the hinge. The arm 54 is biased at the home position, but it rotates at least a limited degree as the shaft 46 moves outward. The degree in which the arm 54 rotates may be limited, wherein a block or a similar functioning mechanism can cease rotation. Alternatively, the degree in which the arm 54 rotates may be unlimited as long as force is applied against the bias and/or the mechanical systems 20, 30, 34 are operating.

One means to limit the pivotal range of the arm 54 is to include an extension 60 extending outwardly in proximity to the hinge connection (or lower half portion of the arm 54) at an angle (illustrated as approximately 90-degree) which will cause the extension 60 to contact the platform 56 after a predetermined degree of rotation is reached. The angle between the arm 54 and the extension 60 may correspond to the second position of the shaft 46 movement and, more specifically, may correspond to the maximum thickness of media that the mechanical systems 20, 30, 34 can accept.

In another embodiment, however, the extension 60 can bisect a focus beam, which corresponds to the maximum thickness of media that the mechanical systems 20, 30, 34 can tolerate without too excessive a load being applied to the systems. The core mount assembly 10 includes a sensor 62, which detects when the media thickness exceeds a predetermined threshold value. The sensor 62 includes a transmitter media thickness exceeds a predetermined threshold value. The sensor 62 may include a transmitter component 64 and a corresponding receiver component 66. The transmitter component 64 generates a focus beam, which is received by the receiver component 66. One aspect of the sensor 62 is a location of the transmitter and receiver components 64, 66. At least one of the transmitter 64 and receiver 64 are situated outside of the core mount assembly 10. More specifically, the transmitter and/or receiver 64, 66 may be situated both outside a proximity of the following regions: (1) the compartments and space formed between the inner faces 16 of the of the first and second support members 12, 14; (2) an entrance to the feed slot 36; (3) the feed path 36; and, (4) an exit slot below the feed gap 26. In this manner, an occurrence is minimized of media fragments or dust settling into contact with the sensor components 64, 66.

In another embodiment, the sensor 62 is an optical sensor. The sensor 62 generates a focus beam in proximity to the arm 54 and/or the extension 60. When the thick media urges against the fingers 48, the fingers 48 push the shaft 46 outwardly, and this outward movement translates into a pivotal movement of the arm 54. A path of the focus beam extends across a pivotal path of the arm 54. When the arm 54 bisects the focus beam, it obstructs the beam such that the receiver component 66 of the sensor 62 no longer receives the transmission. When the receiver 66 no longer detects the focus beam, it signals a controller 68.

The core mount assembly 10 further includes a controller 68, which is operatively associated with both the sensor 62 and at least the motor 30. The controller 68 can be operatively associated with other indication systems utilized in the device, such as, for example, bin full capacity. The controller 68 is programmed to recognize the signal sent from the receiver component 66 as a detected fault condition. In this manner, the controller 68 may control at least one of the following actions: (1) suspend the motor 30 for at least a predetermined amount of time; (2) reverse the motor 30 to reverse a rotation of the cutting cylinder(s) 20 for a predetermined duration; (3) activate an indication system to warn the operator of the fault condition; and (4) any combination of the foregoing. The warning can be a visible warning communicated to the operator by means of a display that illuminates. Alternatively, the warning can be an audible warning communicated to the operator by one or a series of beeps. Alternatively, the warning can be a visible or an audible message stating that the fault condition is met or that the media (stack) is too thick.

FIG. 7 illustrates the second operative mode for the moveable shaft embodiment of the core mount assembly 10 when the thickness fault condition is detected. The figure illustrates the media pushing against the fingers 48. As the media is forced downwardly through the feed path 36 toward the space between the counter-rotating cutters 20, the fingers 48 are urged in a generally downward or outward direction. Because the fingers 48 are not rotatably attached to the shaft 46, they do not rotate about the shaft 46; rather, overly thick media will push against the fingers 48 and cause the fingers 48 to similarly push outwardly against the shaft 46. The shaft 46 is moved away from the throat plate 38. As the shaft 46 is moved from the first position toward the second position, the arm 54 pivots in a same (illustrated as clockwise) direction. When the arm 54 bisects the focus beam of the sensor 62, it causes the controller 68 to activate the illustrated operative mode, wherein the operation of the mechanical systems 20, 30, 34 is suspended. When the operations are suspended, the operator may pull the media from the feed slot 36 or the controller 68 may reverse rotation of the cutting cylinders 20 to assist in removing the media from the feed path 36. Once the media is removed from the feed path 36, the bias of the arm 54 returns the shaft 46 and the fingers 48 to the home position (i.e., the first operative mode).

In another contemplated embodiment (not shown), a downwardly and/or outwardly force against the fingers 48 can cause the shaft 46 to lift upwardly toward a second position. In this embodiment, the arm 54 similarly may be pulled in an upwardly direction instead of pivoting. An arm 54 of this contemplated embodiment can attach to the platform 56 by means of a tension coil spring (not shown). Therefore, an upward pull on the arm 54 will act against the tension (or bias) of the spring and generally extend the string. The extension moves the arm 54 from a first position to a second position, wherein the arm bisects the focus beam of the thickness detection sensor 62. When the media is removed from the feed path 36, the fingers 48 return to their home position by means of the arm 54 dropping downward by a compression or bias of the tension spring. The arm 54 returns the shaft 46 to its home position, and hence the fingers 48 are returned to their home position generally above their fault position.

Other embodiments are contemplated which function to signal the controller 68 that a thickness fault condition is detected. For example, the extension 60 of the arm 54 can contact a tactile switch (not shown), wherein the contact completes a circuit which communicates the condition to the controller 68. Alternatively, the extension 54 can contact any mechanical or electrical switch that functions to send a signal to the controller 68. In other contemplated embodiments, the arm 54 can connect to an inner face 16 of the first support member 12, wherein an attachment point or a platform 56 extends inwardly from the inner face 16 behind the illustrated motor compartment 32. More specifically, the attachment is situated in a region segmented away from the feed path 36 and the cutting cylinders 20. In this manner, the optical sensor 62 is sheltered from fragments and debris and other environmental contaminants floating into the feed path 36 from an exterior of the device housing the core mount assembly 10 and communicating thereto. In this contemplated embodiment, the sensor components 64, 66 are similarly situated in proximity to the arm 54 in the segmented compartment (illustrated as the motor compartment 32).

While portions of the foregoing disclosure were directed toward the arm 54 at one terminal end of the shaft 46, which communicates with the focus beam of the optical sensor 62 (or similar performing switch-type sensor) and is moveable in a region removed from the feed path and the cutting cylinders to shelter the sensor, the other terminal end of the shaft may not utilize a similar arm connection as there is no movement toward a sensor. In one embodiment associated with pivotal movement of the arm 54 at the shaft 46 connection (i.e., rotatable shaft embodiment), a second pin member can maintain no linear movement of the shaft at the second terminal end of the shaft. In one embodiment associated with pivotal movement of the arm 54 at the platform 56 connection (i.e., the moveable shaft embodiment), a second arm is situated at the other terminal end of the shaft 46. This second arm does not need to be situated beyond the outer face 18 of the second support member 14 because it will not communicate with a similar sensor 62. Therefore, this arm can include an equal or an unequal length so long as the corresponding portion of the shaft 46 is capable of matching the movement of the remaining portions of the shaft 46.

The illustrated embodiment shows the second terminal end of the shaft 46 attached to the inner face 16 of the second support member 14. In one embodiment, the inner face 16 can include a slot (not shown) of a limited length for corresponding travel of the shaft 46. A distal pin, for example, can travel along the slot. The slot can be configured to follow a path of the movement of the shaft 46 from the first position to the second position.

Any configuration for movement of the second terminal end of the shaft 46 is contemplated as long as the shaft 46 is capable of translating movement to a connecting arm member situated beyond an outer perimeter of mechanical systems such that the arm comes into contact with a detection sensor focus beam extending similarly beyond the mechanical systems. In this way, the sensor components are situated generally outside of support members and away from the other components supported by the core assembly and are completely sheltered from potentially runaway fragments and dust from the external environment.

The core mount assembly 10 of the present disclosure is described for containment in a housing of an article destruction device. The article destruction device can be the media shredder 100 shown in FIG. 8, wherein a head assembly 120 can include a media feed slot 140 dimensioned for receipt of the at least generally planar sheet of media. The anti-jam assembly can be incorporated in the media shredder device 100 for shredding the generally planar media into strips or fragments of chad. The media shredder device 100 further includes a bin 160 having a containment space 180 for collection of the shredded media. The head assembly 120 is situated adjacent to the bin 160. The head assembly 120 houses the core mount assembly shown in FIG. 1, wherein media fed through the feed slot 140 is shredded as it travels between the cylinders 30. The shreds then fall into the bin 160, where the shreds are collected until they are subsequently emptied into a trash receptacle.

Although a media shredder is illustrated, the teachings of this disclosure and, more specifically, the core mount assembly, are contemplated for use in other destroying devices. Contemplated devices include destroying mechanisms for glass, bottles, and farming equipment, and disposals for food, etc.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A shredder device for fragmenting at least one media sheet having a variable thickness, comprising:

a bin including a containment space for collecting fragments formed from the at least one media sheet; and, a head assembly adjacent to the bin, including:

a core mount assembly supporting a motor drive assembly and a cutter assembly including a at least one cutting shaft, where the core mount includes first and second support members that rotatably support the cutting shaft between inner faces of the first and second support members such that the cutting shaft extends generally perpendicular to the first and second support members, and where the first and second support members have outer faces opposite their respective inner faces, an optical sensor generating a focus beam for sensing the variable thickness of the at least one media sheet and positioned adjacent the outer face of the first or second support member; a controller operatively associated with the optical sensor and the motor drive assembly, and, a media feed path directing a travel of the at least one media sheet toward the cutter assembly;

wherein the optical sensor is removed from both the media feed path and the cutter assembly such that it generates the focus beam away from a proximity of the media feed path and the cutter assembly.

2. The shredder device of claim 1, wherein the media feed path is defined by a first generally planar surface situated above the cutter assembly and at least two rollers situated above the cutter assembly opposite the planar surface, wherein the rollers assist in the at least one media sheet gliding through the media feed path.

3. The shredder device of claim 2, wherein the at least two rollers are each included on fingers extending outwardly in a spaced apart relationship from an elongate member situated generally parallel to the cutter assembly.

4. The shredder of claim 3, wherein the elongate member is affixed to an arm member that is pivotal about a limited degree of rotation.

5. The shredder of claim 4, wherein the elongate member is configured to transmit downward movement of the fingers to an angular movement of the arm by the elongate member moving outwardly from a first position to at least a second position.

6. The shredder of claim 5, wherein the arm member is in a position to bisect the focus beam when the arm member is in the second position.

7. The shredder of claim 1, wherein an interruption of the focus beam causes the optical sensor to signal the controller to prevent, cease or reverse operation of the motor drive assembly.

* * * * *